US009352350B2

(12) United States Patent
Arminak

(10) Patent No.: US 9,352,350 B2
(45) Date of Patent: May 31, 2016

(54) ROLL-ON APPLICATOR

(71) Applicant: Arminak & Associates, LLC, Azusa, CA (US)

(72) Inventor: Armin Arminak, Pasadena, CA (US)

(73) Assignee: Arminak & Associates, LLC, Azusa, CA (US)

( * ) Notice: Subject to any disclaimer, the term of this patent is extended or adjusted under 35 U.S.C. 154(b) by 275 days.

(21) Appl. No.: 13/934,590

(22) Filed: Jul. 3, 2013

(65) Prior Publication Data

US 2014/0010582 A1 Jan. 9, 2014

Related U.S. Application Data

(60) Provisional application No. 61/667,478, filed on Jul. 3, 2012.

(51) Int. Cl.

| | |
|---|---|
| ***B67D 7/06*** | (2010.01) |
| ***B43K 23/08*** | (2006.01) |
| ***A45D 34/04*** | (2006.01) |
| ***B43K 7/03*** | (2006.01) |
| ***B05C 1/00*** | (2006.01) |
| *B05C 17/00* | (2006.01) |

(52) U.S. Cl.

CPC ..... *B05C 1/00* (2013.01); *A45D 34/041* (2013.01); *A45D 2200/051* (2013.01); *B05C 17/002* (2013.01)

(58) Field of Classification Search

CPC ..... B05C 1/00; B05C 17/002; A45D 220/051
USPC ..... 401/209, 208, 212–217; 222/321.7, 222/187, 545
See application file for complete search history.

(56) References Cited

U.S. PATENT DOCUMENTS

| | | | | | |
|---|---|---|---|---|---|
| 600,299 | A * | 3/1898 | Warner | B43K 1/086 | 401/214 |
| 1,485,181 | A * | 2/1924 | Grund | B43K 1/08 | 401/214 |
| 1,563,408 | A * | 12/1925 | Sutherland | B43K 1/08 | 401/214 |
| 1,714,030 | A * | 5/1929 | Le Boeuf | B65D 47/248 | 137/515.5 |
| 2,113,695 | A * | 4/1938 | Krannak | B65D 47/248 | 222/501 |
| 2,122,580 | A * | 7/1938 | Morris | A45D 34/041 | 15/172 |
| 2,564,755 | A * | 8/1951 | Fehling | B43K 1/08 | 401/214 |
| 2,613,382 | A * | 10/1952 | Patterson | A45D 34/041 | 401/214 |
| 2,622,257 | A * | 12/1952 | Lemonds | A63B 47/04 | 15/104.92 |
| 2,663,891 | A * | 12/1953 | Hanryon | A45D 34/041 | 401/212 |
| 2,706,474 | A * | 4/1955 | Ackerman | A61H 15/02 | 118/258 |

(Continued)

FOREIGN PATENT DOCUMENTS

CH 270136 11/1950

*Primary Examiner* — Mark A Laurenzi
*Assistant Examiner* — Thomas M Abebe
(74) *Attorney, Agent, or Firm* — Woodard Emhardt Moriarity McNett & Henry LLP

(57) ABSTRACT

A roll-on applicator for use in applying a flowable media to a surface includes a housing which is constructed and arranged so as to define a first chamber and a second chamber which is in communication with the first chamber, a generally-spherical ball received within the first chamber, a spring-biasing valve received within the second chamber and a sealing insert positioned between the ball and the valve. The sealing insert is moveable between a first position wherein a flow passageway between the first and second chambers is open and a second position wherein the flow passageway between the first and second chambers is closed.

35 Claims, 4 Drawing Sheets

(56) References Cited

U.S. PATENT DOCUMENTS

| | | | | | |
|---|---|---|---|---|---|
| 2,837,756 | A | * | 6/1958 | Barlow | B65D 47/36 15/105 |
| 3,111,703 | A | * | 11/1963 | Kaufman | 401/214 |
| 3,137,886 | A | | 6/1964 | De Groft | |
| 3,481,678 | A | | 12/1969 | Schwartzman | |
| 4,221,494 | A | | 9/1980 | Kachur | |
| 4,993,860 | A | | 2/1991 | Sommer | |
| 5,056,949 | A | | 10/1991 | Petrillo | |
| 5,277,510 | A | | 1/1994 | Okamoto et al. | |
| 5,482,393 | A | | 1/1996 | Sekiguchi et al. | |
| 5,586,694 | A | | 12/1996 | Breidenbach et al. | |
| 5,810,495 | A | * | 9/1998 | McAuley | A45D 34/041 401/213 |
| 5,897,267 | A | | 4/1999 | Poolman et al. | |
| 6,179,505 | B1 | | 1/2001 | Oder, III et al. | |
| 6,447,194 | B2 | | 9/2002 | Bonningue | |
| 7,293,930 | B2 | | 11/2007 | Chuang | |
| 7,651,292 | B2 | | 1/2010 | Tavares da Silva | |
| 7,674,061 | B2 | | 3/2010 | Baines et al. | |
| 2006/0115318 | A1 | | 6/2006 | Santini et al. | |

* cited by examiner

ROLL-ON APPLICATOR

REFERENCE TO RELATED APPLICATION

This application claims the benefit of U.S. Provisional Application Ser. No. 61/667,478 filed Jul. 3, 2012, which is hereby incorporated by reference in its entirety.

BACKGROUND

Roll-on liquid applicators for dispensing a liquid in a controlled amount may employ a spring-biased ball which is captured within an upper chamber of a housing. In this style of applicator the ball is movable between a first or closed position and a dispensing position where the ball is moved away from an edge of the housing. Applicators of this type typically rely on sealed interfaces, not only around the ball, but with other components which are received within the housing. The effectiveness and reliability of these sealed interfaces is an important design consideration. When roll-on liquid applicators are used for dispensing a low-viscosity liquid, the design considerations for effective and reliable sealing take on added importance.

When this type of roll-on liquid applicator is not in use, it is important to prevent evaporation loss of the liquid. This design consideration is applicable for the primary liquid reservoir or supply and is applicable for the staged liquid supply which may be in a chamber which is in flow communication with and/or in direct contact with the ball. As these design aspects are evaluated relative to the potential for an improved construction, the cost of the component parts, the ease of assembly of those parts and the reliability of the fits between mating parts, including sealing integrity and overall performance, take on added importance. While the focus of the present disclosure is on a roll-on "liquid" applicator the actual construction and the design of the component parts would be applicable to any flowable media, whether a low-viscosity liquid or a flowable media with a higher viscosity. In fact, even certain powder compositions could be classified as "flowable" and the only design considerations which would have to be made would be on the size of clearance spaces and/or flow openings such that the selected flowable media would be able to pass therethrough.

When a selected manner of sealing the interface between two (2) structures introduces variables which are difficult to control or when the structures are more costly to produce, a new construction offers opportunity for improvement. For example, trying to establish a sealed interface between a conical surface and an annular edge typically leaves little margin for error if the intended area of contact is a relatively narrow line. Under these conditions, if either surface is slightly out of round or warped, the abutment between these two (2) components could leave gaps or separation which could be susceptible to liquid leakage and/or evaporation of some portion of the liquid supply, depending in part on the viscosity of the liquid. Evaporation is a greater concern when a highly volatile liquid is going to be dispensed by the applicator.

Some designs introduce component part complexities which are less reliable in terms of their fit, sealing and performance and at the same time these component parts may be more expensive to produce. If these same part complexities create abutment interfaces which are difficult to seal, a new construction offers opportunities for improvement. It might be possible to improve the overall construction of these types of roll-on applicators by the use of an additional component part. Although a reduction in the number of component parts might be thought of as always being a desirable design pursuit, sometimes adding a part can contribute to the overall reliability and performance of an assembly. This is the case with the roll-on applicator of the present disclosure.

SUMMARY

The disclosed roll-on applicator includes a housing, a ball which is captured within the housing, a valve and a sealing insert positioned between the ball and the valve. The valve includes a spring member for spring-biasing the ball. Use of the roll-on applicator applies a force to the ball and moves the ball from a first position or starting position through an intermediate position to an ending position. The sealed condition which is achieved in the ending position is between the sealing insert and a ledge of the housing. The shape characteristics of the sealing insert and the housing ledge establish a more reliable sealed interface as compared to other designs such as pushing a ball against an annular corner or edge. The disclosed roll-on applicator provides a wider annular ring area of abutment contact as compared to earlier designs which create what is essentially an annular line of abutment contact between the ball and an annular corner or edge.

This larger area of abutment contact which is provided by the roll-on applicator disclosed herein is the result of adding the sealing insert and positioning this insert between the ball and the referenced ledge of the housing. This housing ledge includes a depending annular lip which in one position abuts up against an annular surface of the valve. Adding a tapered shape to the annular lip adds flexibility to the tip and thereby enhances the integrity and reliability of the seal. This type of abutment interface provides more reliable sealing as compared to a conical surface being pushed against an annular corner or edge, something which is considered to be a deficiency found in earlier roll-on applicator constructions.

DESCRIPTION OF THE SELECTED EMBODIMENTS

Figure 1:
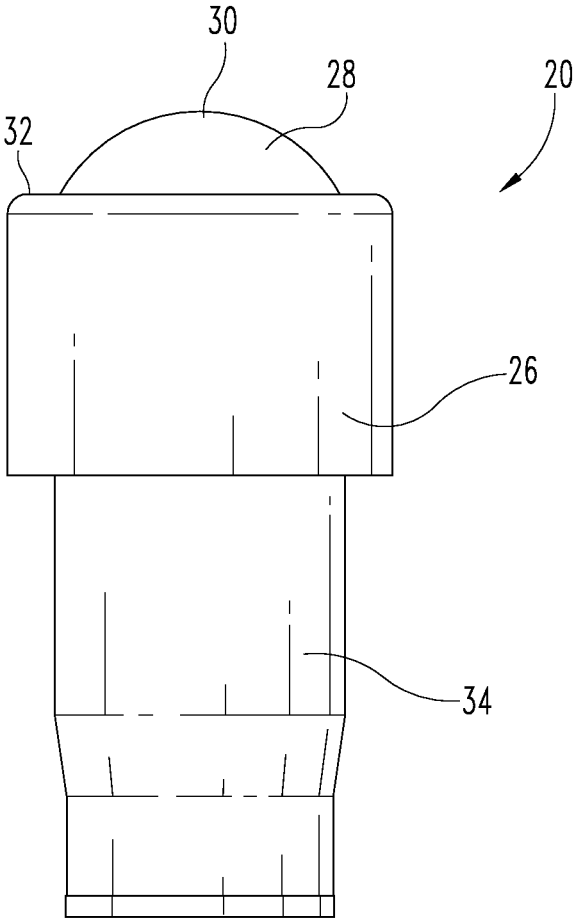
FIG. 1 is a front elevational view of a roll-on applicator according to the present disclosure.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 7:
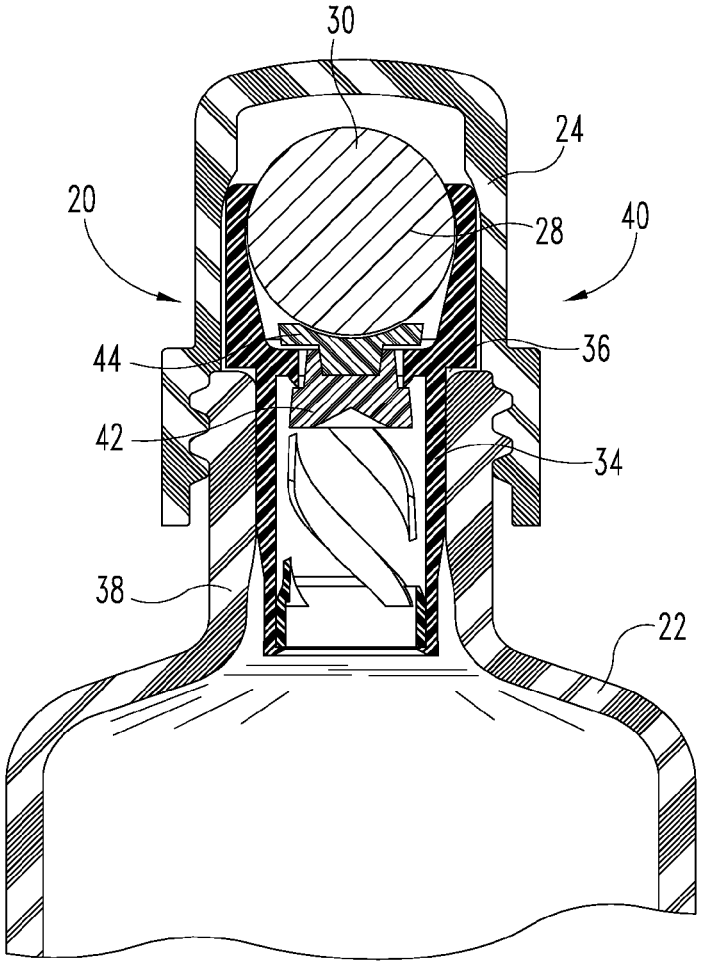
FIG. 7 is a partial, front elevational view, in full section of the FIG. 1 roll-on applicator as assembled into a bottle and as enclosed by a closing cap which is threaded onto a neck of the bottle.

Referring to FIG. 1 there is illustrated a roll-on applicator 20 which is representative of the disclosed embodiment. Inventive features of the disclosed embodiment are incorporated into roll-on applicator 20. The end-use of roll-on applicator 20 will typically be in combination with a liquid supply container, such as bottle 22, and a threaded closing cap, such as cap 24, see FIG. 7. Roll-on applicator 20 includes a single-piece, unitary housing 26, preferably fabricated out of plastic, and a generally spherical applicator ball 28 which is captured by housing 26. The housing 26 is generally annular throughout, including its interior shapes and structures.

In the upright position or orientation of FIG. 1, the upper portion 30 of ball 28 protrudes beyond the upper edge 32 of the housing 26, the lower portion 34 of housing 26 is constructed and arranged to fit securely within the annular opening 36 of the neck 38 of bottle 22. For the purposes of position and orientation references, the staged or ready-for-use orientation of FIGS. 1 and 7 reflect how the applicator 20 and the applicator assembly 40 (applicator 20, bottle 22 and closing cap 24) would typically be positioned on a generally horizontal support surface, such as a countertop. Based on this initial, upright orientation, the ball 28 protrudes in an upward direction out of the "top" of the housing 26. As shown in the FIG. 1 illustration, the upper edge 32 of housing 26 contacts ball 28 at a location which is above the diameter of ball 28. By placing the upper edge 32 above the diameter of the ball 28, the ball 28 remains captured within housing 26. The referenced "diameter" corresponds to a diameter line through ball 28 which is substantially parallel with the plane of edge 32.

When the applicator 20 is used in a normal or intended manner to apply or dispense a portion of the liquid within housing 26, the applicator 20 is tilted (or inverted) so as to enable gravity feed of liquid onto the surface of the ball. Then as the ball rolls, liquid is applied to a surface. Depending on the positioning and orientation of the surface to be contacted by the ball 28, the applicator 20 could be completely inverted so as to direct the ball 28 downwardly as opposed to simply tilting the applicator 20 at some angle of incline. As the ball 28 is moved across the selected surface, surface friction causes the ball 28 to turn or rotate within housing 26 and to roll on axis. As the ball rolls, a liquid coated portion of the outer surface of the ball 28 moves into contact with the surface and transfers liquid onto the surface.

In the context of the present disclosure, the focus is on applying a liquid to the surface. The viscosity of this liquid will have an influence on the extent or magnitude of any flow gaps or separation which may need to be established in order for the liquid to coat the ball and for that liquid to be applied to a surface as the ball rolls. If a more viscous liquid is selected for dispensing from roll-on applicator 20, additional clearance or separation might be required between some of the components parts of roll-on applicator in order to allow this more viscous liquid to properly flow in the intended manner of use associated with roll-on applicator 20. It is also anticipated that the construction and arrangement of roll-on applicator 20 would be suitable to apply a flowable powder and for this reason a more generic reference to the material to be applied to the work surface is a "flowable media" which is intended to encompass not only liquids of various viscosities, but other materials which could be applied by means of roll-on applicator 20.

Figure 4:
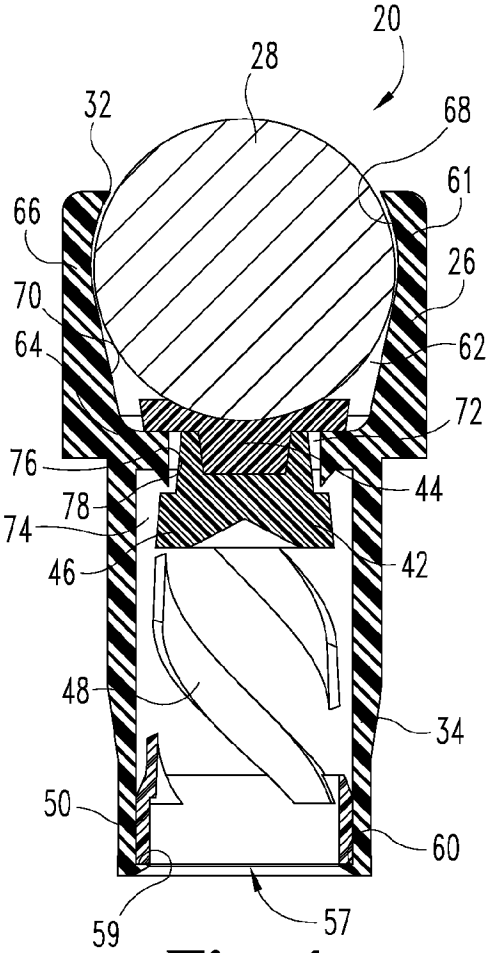
FIG. 4 is a front elevational view, in full section, of the FIG. 1 roll-on applicator, depicting the roll-on applicator in a third position.
Figure 3:
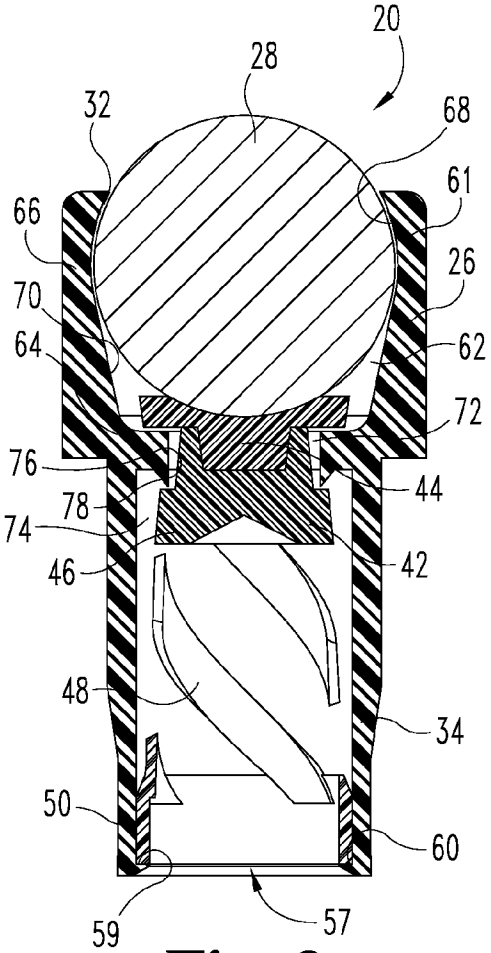
FIG. 3 is a front elevational view, in full section, of the FIG. 1 roll-on applicator, depicting the roll-on applicator in a second position.
Figure 2:
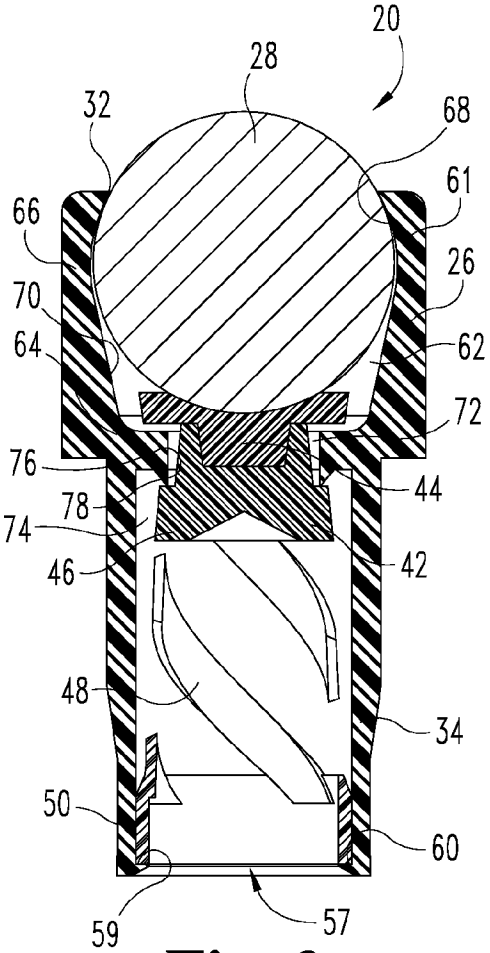
FIG. 2 is a front elevational view, in full section, of the FIG. 1 roll-on applicator, depicting the roll-on applicator in a first position.
Figure 6:
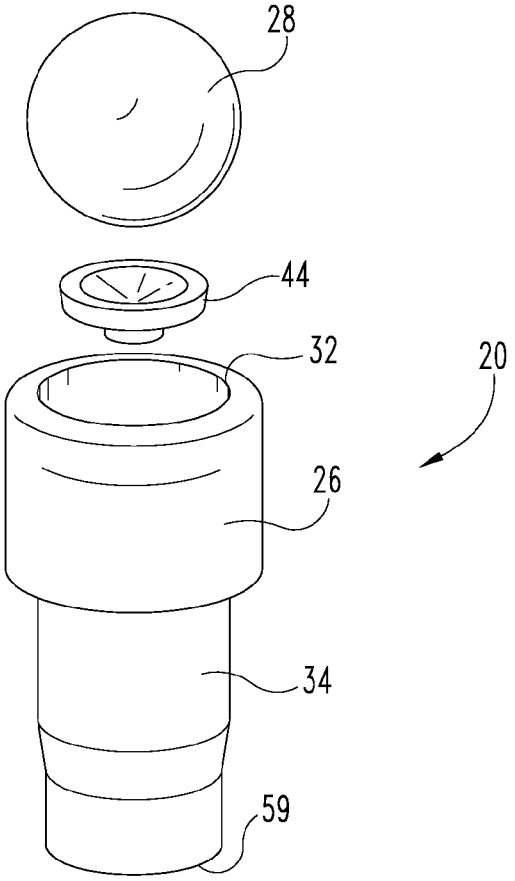
FIG. 6 is a perspective view of a sealing insert which comprises one component part of the FIG. 1 roll-on applicator.
Figure 6:
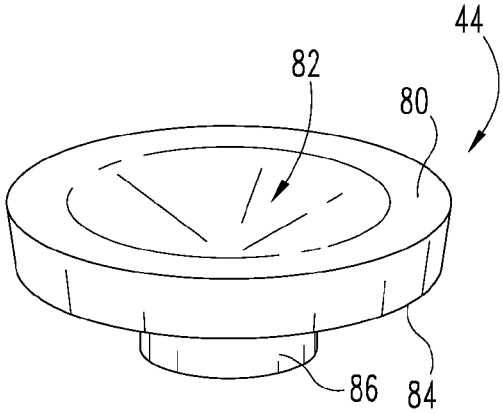
Figure 5:
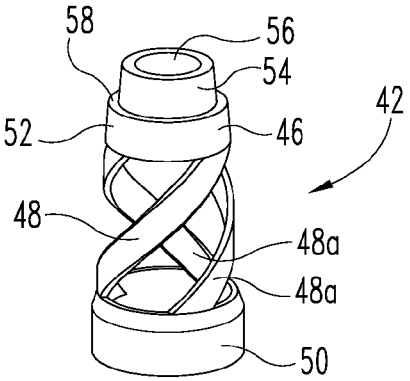
FIG. 5 is an exploded, perspective view of the FIG. 1 roll-on applicator.

The additional component parts of roll-on applicator 20 include a spring-biasing valve 42 and a sealing insert 44 (see FIGS. 2-4). Valve 42 includes a valve head 46, a helical spring 48, which may be plastic, and a base 50. The spring-biasing construction of this valve 42 is found in the fact that the valve head 46 can be pushed closer to base 50 by compression of the helical spring 48. In one embodiment the valve is a single-piece, unitary component which is molded out of plastic. The helical shape provides the spring-biasing construction. The valve head 46 (see FIG. 5) has a lower portion 52 which may be frustoconical in shape and a smaller, generally concentric, upper portion 54 which may be frustoconical in shape. Upper portion 54 defines a generally concentrically centered recess 56 which is suitably sized and shaped for receiving lower portion 86 of sealing insert 44. A closely sized fit is desired so that the valve head 46 and the sealing insert 44 move together as a unit. In the exemplary embodiment recess 56 and lower portion 86 have matching frustoconical shapes. The size difference between the upper portion 54 and lower portion 52 creates an annular ring ledge 58 as part of the lower portion 52. Base 50 receives and integrally secures the lower ends of the helical coils 48*a* which create spring 48. Base 50 is open so as to admit the flow of liquid from the liquid supply held within bottle 22. The lower edge 59 of housing 26 includes an inwardly directed annular lip 60 which provides an abutment surface for base 50. The lower edge 59 of lower portion 34 defines a flow opening 57 which is aligned with the flow opening in base 50. The annular lip 60 which provides the abutment surface for base 50 surrounds both the flow opening in base 50 and the flow opening 57 in the lower portion 34 of housing 26. The relationship between base 50 and the lower edge 59 is preferably a line-to-line fit to help maintain alignment of spring 48 within housing 26.

With continued reference to FIGS. 1 and 2, the housing 26 includes an upper portion 61 and lower portion 34. The upper portion 61 defines an upper chamber 62 which receives the ball 28. Upper chamber 62 is bound by upper edge 32 at the top of upper portion 61 and by annular shelf 64 which is positioned beneath ball 28. The upper portion of housing wall 66 has a curved inner surface 68 which is directly below edge 32 and is sized and shaped to closely conform to the generally spherical surface of ball 28. This conforming curvature extends to the inner surface of upper edge 32. Below the geometric center of ball 28, the housing wall 66 has an inner surface 70 which tapers inwardly and intersects with the upper surface of shelf 64. The center portion of shelf 64 includes an annular opening 72 which functions as a liquid portal for liquid flow from lower chamber 74 into upper chamber 62. The lower portion 34 of housing 26 defines lower chamber 74. Depending on the positions of insert 44 and valve 42 relative to shelf 64, opening 72 becomes a flow passageway between the first and second chambers.

The annular opening 72 is defined in part by the upper portion 61 and in part by lower portion 34. Adjacent the lower edge 76 of the opening 72 is a depending sealing lip 78 which has a tapered shape, converging in a downward direction to a tip. The lower chamber 74 has a generally cylindrical shape and receives a majority of valve 42. As illustrated in FIG. 2, the valve head 46 extends upwardly into opening 72 and ledge 58 is spring-biased into sealing contact against annular sealing lip 78.

The flow opening which is defined in part by shelf 64 and defined in part by lower portion 34, in particular by sealing lip 78, can be thought of as a transition flow opening 72 between the upper chamber 62 and the lower chamber 74. Further, whenever reference is made herein to a particular component or a portion of a component being "received" within a certain chamber, volume or space, that is to be interpreted as having at least a portion of that component part or structure as being actually received in the identified chamber, volume or space. For example, the valve would properly be described as being received within the lower chamber 74, even though a portion of the valve head extends into the transition flow opening between the two (2) chambers. Similarly, the sealing insert 44 could be described as being received within the upper chamber 62 even though the frustoconical lower portion 86 of the sealing insert 44 extends into that transition flow opening between the two (2) chambers.

The sealing insert 44 is constructed and arranged as a single-piece, unitary, elastomeric member with an annular upper portion 80 which defines a generally concentric, part-spherical depression 82. Depression 82 is sized and shaped so as to generally match part of the generally spherical size and shape of ball 28. This size and shape compatibility between depression 82 and the surface of ball 28 allows the ball to seat fully in depression 82 with an area of contact between these two components. The underside surface 84 of upper portion 80 is annular and substantially flat so as to be able to seal against the upper surface of shelf 64 with an area of contact (See FIG. 4).

The annular lower portion 86 of sealing insert 44 is tapered (i.e. frustoconical) so as to generally correspond to the size and shape of frustoconical recess 56. This size and shape compatibility allows the lower portion 86 to fit into recess 56 with a snug fit. Based on this snug fit, the valve head 46 and sealing insert 44 move together as a single unit. Lower portion 86 is generally concentric with upper portion 80 and with depression 82.

There are three (3) position orientations for roll-on applicator 20 and these three (3) position orientations are illustrated in FIGS. 2, 3 and 4. FIG. 2 represents a starting position for the roll-on applicator 20 and orientation of the component parts before use of the roll-on applicator 20 has been initiated. In this starting, upright position and orientation, the ball 28 is pushed up against upper edge 32 so as to establish a generally sealed fit between the ball 28 and the housing 26 at this location, thereby preventing any noticeable leakage of liquid between upper edge 32 and ball 28. The force which pushes ball 28 up against upper edge 32 is due to the spring force supplied by spring-biasing valve 42. The spring 48 acts against base 50 which abuts up against lower edge 59 at one end. The opposite end of spring 48 acts against valve head 46. In turn, the valve head 46 pushes against sealing insert 44 which in turn pushes against ball 28. As is illustrated, the ledge 58 is in alignment with and is pushed up against the depending sealing lip 78. The tapered design of sealing lip 78 allows the tip of lip 78 to compress slightly so as to establish not only a sealed interface against ledge 58, but a sealed interface which is an area of annular-ring shape as opposed to a point or line contact. Slight compression of the tip of sealing lip 78 increases the contact area of that tip and that is the area which contacts ledge 58. Depending on the specific valves and dimensions, this construction for lip 78 may allow for some extra tolerance between the ball and the upper seal lip 32. This construction of lip 78 may also allow slight downward movement of ball 28 to allow application while still forming a seal on edge 78. The stack of spring-biased and abutting component parts pushes ball 28 against upper edge 32. As noted, this sealing fit of the ball up against upper edge 32 helps to prevent any noticeable liquid leakage and helps to prevent any noticeable liquid evaporation from within upper chamber 62 as well as from lower chamber 74.

A second position and orientation of applicator 20 is represented by FIG. 3. The manner of intended use of applicator 20 contemplates that when a line of liquid is to be applied (i.e. rolled on a surface) from the ball 28 to the surface, the applicator 20 will be tilted or inverted in some fashion, similar to the use of a writing instrument with the ball 28 being comparable to the roller ball of a pen. The actual first step for use of applicator 20 is to unscrew the closing cap 24 from the neck of bottle 22. Thereafter it is the combination of the applicator 20 and bottle 22 which is tilted or inverted. Although the bottle 22 remains a part of this discussion, the focus of this disclosure is on the construction, arrangement and use of roll-on applicator 20. Further, the illustrations of applicator 20 in FIGS. 3 and 4 are intentionally not tilted or inverted so as to be able to more easily compare the component part positions and the changes in those positions as between FIGS. 2, 3 and 4. It is to be understood though that the most likely manner of use of applicator 20 is to tilt or invert the applicator 20 (and bottle 22) such that the ball 28 is directed in a downward direction.

As the ball 28 is initially pushed against the work surface which is to receive a line of liquid from applicator 20 with a moderate level of force, the ball 28 pushes inwardly against the valve 42. If the force applied against the upper portion 30 of the ball exceeds the spring force of spring 48, the ball moves inwardly, a very slight distance, away from upper edge 32. This movement creates a slight separation between the ball 28 and the upper edge 32 which makes it easier for the ball to roll and for liquid on the surface of the ball to be applied to the work surface. During this initial movement of the ball 28, as represented by FIG. 3, other components of applicator 20 experience a slight movement as well, due in part to the abutment stacking of the ball, the sealing insert 44, the valve 42 and the lower edge 59 of housing 26. During this initial FIG. 3 movement of the ball 28, the underside surface 84 of the sealing insert 44 moves closer to shelf 64. The initial positioning the surface 84 has it spaced apart from shelf 64 as illustrated in FIG. 2. At this same time of initial movement, ledge 58 is moved away from sealing lip 78. This movement and the separation which results creates a flow opening for liquid from lower chamber 74 to be able to flow into upper chamber 62. In order for liquid to flow from the lower chamber to the upper chamber, the applicator needs to be tilted or inverted since the flow mechanism is gravity.

With increased pushing force on ball 28, additional movement occurs and this position and orientation are presented by the FIG. 4 illustration. With this additional force, the ball moves farther away from upper edge 32. In turn, due to the abutment stack of component parts, the underside surface 84 of the sealing insert 44 is moved into sealing contact against shelf 64. This sealing contact between surface 84 and shelf 64 closes off any flow opening or separation and thus any flow path between the lower chamber 74 and the upper chamber 62. This in turn means that the available liquid for roll-on application is the volume of liquid which is captured in the upper chamber 62. However, reduction in the force on ball 28, such that the applicator returns to the FIG. 3 position and orientation opens up a liquid flow path between the two chambers. If the applicator is tilted or inverted then gravity acts on the liquid in the lower chamber 74 allowing the liquid in that chamber to flow into the upper chamber 62 in order to refill any "shortage" of liquid in the upper chamber 62. A "shortage" would be the result of liquid having been spent from the upper chamber. At some point, the upper chamber liquid supply needs to be replenished for any liquid which has been applied. Obviously, with gravity flow, when the upper chamber is filled with liquid, no flow occurs as there is no shortage to be made up and no empty space or volume to be refilled. When the force on ball 28 is removed and the applicator 20 is returned to an upright position and orientation, the applicator condition of FIG. 2 is re-established. If the applicator 20 is not going to be used again, at least for some interval of time, the cap 24 would likely be reapplied to the bottle.

The use of sealing insert 44 enables certain design decisions for the valve 42 and for the housing 26 which are considered to be beneficial to the overall design and construction of ball-captured, roll-on applicators. One of the important considerations for roll-on applicators is the integrity and reliability of the various seals and sealed interfaces. One feature of sealing insert 44 is the part-spherical depression 82 which matches the size and shape of the generally spherical ball 28. This construction provides a larger area of sealing contact and should minimize any sealing issues which might result from having only a point or line contact for the designed sealing. Additionally, the upper portion 80 has an annular-ring shape and a relatively large annular underside surface 84 which is adjacent the upper surface of shelf 64. Here again, when sealing contact is made between surface 84 and shelf 64, there is a relatively large area of abutment and sealing contact. This large area of sealing contact should minimize any sealing issues which might result from having only point or line contact for the desired sealing.

The use of sealing insert 44 also facilitates the specific design selected for valve head 46 and the specific design selected for sealing lip 78. These two (2) portions cooperate to establish a sealed interface at their location of abutment. For this sealed interface the valve head supplies an area for the contact in the form of the annular-ring shape of ledge 58. Since sealing lip 78 tapers to a smaller depending tip, it is expected that with the use of plastic components some compression and spreading of that smaller depending tip will occur due to abutment against ledge 58. This compression of the plastic tip increases the area of contact with ledge 58 and thereby should provide an improved seal at this abutment interface.

Figure 8:
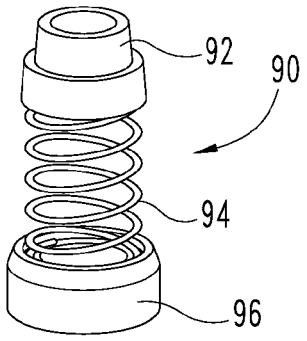
FIG. 8 is a perspective view of an alternative construction for a valve assembly which is suitable for use as a component subassembly of the FIG. 1 roll-on applicator.

An alternative valve construction for applicator 20 is illustrated in FIG. 8. Valve 90 includes three (3) separate components which are assembled into valve 90 as illustrated in FIG. 8. These three (3) components include valve head 92, coil spring 94, and base 96. In the exemplary embodiment of FIG. 8, coil spring 94 is metal. Valve head 92 is essentially the same as valve head 46 in form, fit and function. One difference between these two (2) valve heads is that valve head 46 is an integral part of a single-piece, unitary construction of valve 42 while valve head 92 is a separate component part. The same is true for base 96 and base 50. These two (2) designs are the same in form, fit and function. The only real difference is that base 50 is an integral part of a single-piece, unitary construction of valve 42 while base 96 is a separate component part. Continuing with the separate component part approach for valve 90, the coil spring 94 is a separate component part. One end of coil spring 94 is captured within valve head 92 and the opposite end of coil spring 94 is captured within base 96.

In the alternative valve construction of FIG. 8 for applicator 20, the coil spring 94 is preferably metal. Valve 90 can be assembled using a plastic spring in lieu of metal. An all-plastic construction for all three (3) valve components should be more cost effective as a single-piece, unitary construction, such as valve 42.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A roll-on applicator for use in a applying a flowable media to a surface, said roll-on applicator comprising:

a housing defining a first chamber and a second chamber;

a ball received within said first chamber;

a valve received within said second chamber; and an insert positioned between said ball and said valve, said insert being structurally independent of said housing and moveable between a first position wherein the flow passageway between said insert and said housing is defined and arranged for flow of said flowable media between said first chamber and said second chamber and a second position wherein said flow passageway is closed.

2. The roll-on applicator of claim 1 wherein said valve includes a spring-biased valve head.

3. The roll-on applicator of claim 2 wherein said valve head receives a portion of said insert.

4. The roll-on applicator of claim 1 wherein said housing includes a shelf positioned between said first chamber and said second chamber.

5. The roll-on applicator of claim 4 wherein when said insert is in said first position, said insert is spaced apart from said shelf.

6. The roll-on applicator of claim 4 wherein when said insert is in said second position, said insert is in sealing abutment against said shelf.

7. The roll-on applicator of claim 2 wherein said housing includes a depending sealing lip.

8. The roll-on applicator of claim 7 wherein said valve head includes a ledge which is in alignment with said depending sealing lip.

9. The roll-on applicator of claim 8 wherein said valve head is moveable between a first position where said ledge is spaced apart from said depending sealing lip and a second position where said ledge is in abutment with said depending sealing lip.

10. The roll-on applicator of claim 1 wherein said valve is constructed and arranged as a single-piece, unitary component which includes a valve head, a spring and a base.

11. The roll-on applicator of claim 1 wherein said insert includes an upper portion and a lower portion, said upper portion defining a part-spherical depression.

12. The roll-on applicator of claim 1 wherein said housing defines a flow opening which is positioned between said first chamber and said second chamber.

13. The roll-on applicator of claim 12 wherein a portion of said valve and a portion of said insert are positioned within said flow opening.

14. The roll-on applicator of claim 1 wherein the second chamber of said housing defines a flow opening for communication with a supply container for said flowable media.

15. The roll-on applicator of claim 14 wherein said second chamber includes an annular sealing lip which surrounds said flow opening.

16. The roll-on applicator of claim 15 wherein said valve includes a portion which abuts against said annular sealing lip.

17. A roll-on applicator assembly for use in applying a flowable media to a surface, said roll-on applicator assembly comprising:

a container for receiving a supply of a flowable media;

a roll-on applicator received by said container, said roll-on applicator including a housing defining a first chamber and a second chamber;

a ball received within said first chamber;

a valve received within said second chamber;

an insert positioned between said ball and said valve, said insert being moveable relative to said housing between a first position wherein the flow passageway between said insert and said housing is defined and arranged for flow of said flowable media between said first chamber and said second chamber and a second position wherein said flow passageway is closed; and a closing cap which is constructed and arranged to fit over said roll-on applicator and assemble to said container.

18. The roll-on applicator assembly of claim 17 wherein said valve includes a spring-biased valve head.

19. The roll-on applicator assembly of claim 18 wherein said valve head receives a portion of said insert.

20. The roll-on applicator assembly of claim 17 wherein said housing includes a shelf positioned between said first chamber and said second chamber.

21. The roll-on applicator assembly of claim 20 wherein when said insert is in said first position, said insert is spaced apart from said shelf.

22. The roll-on applicator assembly of claim 20 wherein when said insert is in said second position, said insert is in sealing abutment against said shelf.

23. The roll-on applicator assembly of claim 18 wherein said housing includes a depending sealing lip.

24. The roll-on applicator assembly of claim 23 wherein said valve head includes a ledge which is in alignment with said depending sealing lip.

25. The roll-on applicator assembly of claim 24 wherein said valve head is moveable between a first position wherein said ledge is spaced apart from said depending sealing lip and a second position wherein said ledge is in abutment with said depending sealing lip.

26. The roll-on applicator assembly of claim 17 wherein said valve is constructed and arranged as a single-piece, unitary component which includes a valve head, a spring and a base.

27. A roll-on applicator for use in a applying a flowable media to a surface, said roll-on applicator comprising:

a housing defining a first chamber and a second chamber;

a ball received within said first chamber;

a valve received within said second chamber;

an insert positioned between said ball and said valve, said insert being moveable between a first position wherein the flow passageway between said insert and said housing is defined and arranged for flow of said flowable media between said first chamber and said second chamber and a second position wherein said flow passageway is closed;

wherein said housing includes a shelf positioned between said first chamber and said second chamber; and wherein when said insert is in said first position, said insert is spaced apart from said shelf.

28. A roll-on applicator assembly for use in applying a flowable media to a surface, said roll-on applicator assembly comprising:

a container for receiving a supply of a flowable media;

a roll-on applicator received by said container, said roll-on applicator including a housing defining a first chamber and a second chamber;

a ball received within said first chamber;

a valve received within said second chamber;

an insert positioned between said ball and said valve, said insert being moveable between a first position wherein the flow passageway between said insert and said housing is defined and arranged for flow of said flowable media between said first chamber and said second chamber and a second position wherein said flow passageway is closed;

wherein said housing includes a shelf positioned between said first chamber and said second chamber; and wherein when said insert is in said first position, said insert is spaced apart from said shelf.

29. The roll-on applicator of claim 28 which further includes a closing cap which is constructed and arranged to fit over said roll-on applicator and assemble to said container.

30. A roll-on applicator for use in a applying a flowable media to a surface, said roll-on applicator comprising:

a housing defining a first chamber and a second chamber;

a ball received within said first chamber, said ball being moveable relative to said housing between a flow open condition and one of two flow closed positions; and an insert positioned in contact with said ball, said insert being moveable through three different positions relative to said housing, wherein in one of said three different positions said insert is arranged in sealing contact against said housing for closing off the flow passageway between said insert and said housing.

31. The roll-on applicator of claim 30 wherein said insert has a different position relative to said housing for each of the three possible conditions of the ball relative to the housing.

32. The roll-on applicator of claim 30 which further includes a valve received within said second chamber.

33. A roll-on applicator for use in a applying a flowable media to a surface, said roll-on applicator comprising:

a housing defining a first chamber and a second chamber with a shelf between said first chamber and said second chamber;

a ball received within said first chamber;

a valve received within said second chamber; and an insert positioned between said ball and said valve, said insert being moveable relative to said shelf in order to manage flow from said second chamber to said ball, wherein in one position said insert is moved into sealing contact with said shelf so as to close off the flow passageway between said insert and said housing.

34. The roll-on applicator of claim 33 wherein said insert being moveable between a first position wherein a flow passageway between said first and said second chambers is open and a second position wherein said flow passageway is closed.

35. The roll-on applicator of claim 33 wherein said shelf defining two sealing structures, one sealing structure being in said second chamber for contact by said valve and one sealing structure being in said first chamber for contact by said insert.

* * * * *